United States Patent [19]

Selleck

[11] Patent Number: 5,010,675

[45] Date of Patent: Apr. 30, 1991

[54] FIRE PIN SHIELD

[76] Inventor: Albert B. Selleck, 2000 Palmira Dr., Reno, Nev. 89511

[21] Appl. No.: 483,373

[22] Filed: Feb. 29, 1990

[51] Int. Cl.[5] ..... F41A 17/64

[52] U.S. Cl. ..... 42/70.11

[58] Field of Search ..... 42/66, 70.11, 83, 90, 42/95, 96

[56] References Cited

U.S. PATENT DOCUMENTS

| | | | |
|---|---|---|---|
| 3,085,360 | 4/1963 | Robbins et al. | 42/70.11 |
| 3,191,333 | 6/1965 | Koltun | 42/66 |
| 4,569,144 | 2/1986 | Thurber | 42/70.11 |
| 4,961,277 | 10/1990 | Rosenbaum | 42/70.11 |

*Primary Examiner*—Charles T. Jordan

*Attorney, Agent, or Firm*—John Joseph Hall

[57] ABSTRACT

A generally rectangular firing pin shield having a top and bottom in parallel relationship and parallel sides with a V shaped indentation in its front surface below the top and parallel to the top portion for folding over so that the shield may be used for both small and large size revolvers to protect the firing pin from the impact of bore cleaning rods and to prevent cleaning oils or solvents or dirt or discharge residue from contaminating the working mechanism and ammunition of revolvers, and means for securing the shield to the breech face of a revolver during the cleaning operation.

8 Claims, 1 Drawing Sheet

FIRE PIN SHIELD

BACKGROUND OF THE INVENTION

1. Field of the Invention

The present invention relates to a unique firing pin protection device or shield that covers the firing pin hole in the breech face of a revolver to protect the firing pin and breech face from being struck and damaged by a cleaning brush used to clean the bore of the revolver's barrel and to prevent cleaning oils, solvents, and dirt or other discharge residue from entering the working mechanism of the revolver and rendering the revolver's mechanism or ammunition useless and inoperative.

2. Description of the Prior Art

Applicant is unaware of prior art devices having the construction or capability or ease of use of applicant's invention.

SUMMARY OF THE INVENTION

The present invention provides a firing pin protective device or shield formed from a thin, solid sheet of plastic material with a flat planar front surface and a flat planar rear surface parallel to each other. The shield need not be, but is preferably generally rectangular in shape with rounded corners at its bottom and is provided with two apertures or holes in its upper portion which receive securing members to maintain the shield in a position covering the firing pin hole in the breech face of a revolver.

The shield device is provided with a V-shaped indentation or hinge in the front surface of the shield, forming a hinge section parallel to and close to the top of the shield. The hinge permits folding over of the top portion of the shield so that the shield can be inserted into the frame of a small revolver, while in the open or extended position, the shield can be used for a large of heavy duty type revolver, as well.

The need to protect the firing pin and the working mechanism of a revolver during a cleaning operation is very important. If cleaning oil or solvent or dirt or discharge residue should enter the working mechanism of a revolver, removing them or any of them is difficult to accomplish. Unless such contaminants are cleaned out, upon reloading of the revolver they will exit back through the firing pin hole in the breech face and enter the primer pocket thereby rendering the ammunition useless and incapable of being fired due to the oil soaked primer, and also interfere with the working mechanism of the revolver.

The firing pin shield is particularly appropriate for use by law enforcement officers in the cleaning of service revolvers, but the shield can be used for any type revolver.

It is, therefore, an object of this invention to provide a firing pin shield which protects a revolver's firing pin and breech face from being struck and damaged by a cleaning brush inserted into the bore of the revolver's barrel during a cleaning operation.

Another object of this invention is to provide a firing pin shield which covers a revolver's firing pin hole in the revolver's breech face while the bore of the revolver's barrel is being cleaned, thereby preventing, cleaning oils, solvent, dirt, or discharge residue from entering the revolver's working mechanism and interfering with its operation and/or rendering its ammunition useless and incapable of being fired.

A further object of this invention is to provide a firing pin shield which has the capability of being used on all sizes of revolvers, from the smallest five shot to the largest six shot heavy duty revolver.

A yet further object of this invention is to provide a firing pin shield having the capability of being easily placed in position by a person using one hand to attach the shield to a revolver's hammer while the other hand holds the shield in position.

A still further object of this invention is to provide a firing pin shield which is made of material impervious to lubricants, cleaning oils, and solvents used to clean the bore of a revolver's barrel.

A still further object of this invention is to provide a firing pin shield which is made of material that permits easy and long lasting folding and unfolding of a hinge formed near the top of the shield so that the shield may be used for both small and heavy duty revolvers.

These and other objects will be more readily understood by reference to the following description and claims, taken in conjunction with the accompanying drawings, in which FIG. 1 is a perspective view of an embodiment of the invention.

DESCRIPTION OF A PREFERRED EMBODIMENT

Figure 1:
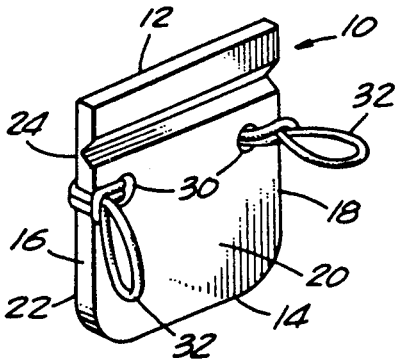
Figure 2:
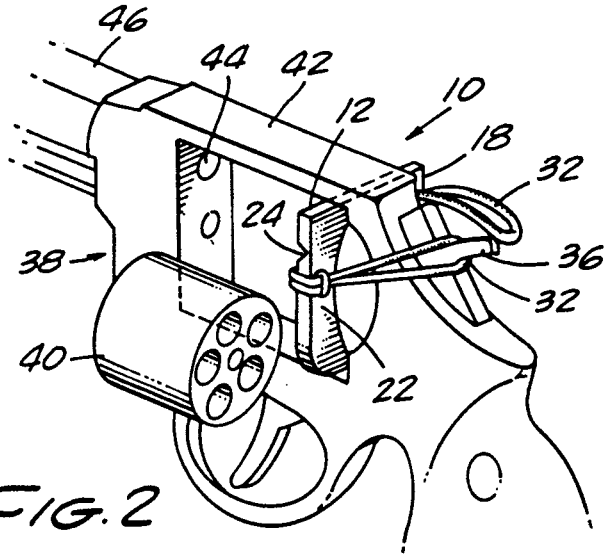
FIG. 2 is a perspective view of a revolver with an embodiment of the invention in the process of being attached to the revolver's hammer.
Figure 3:
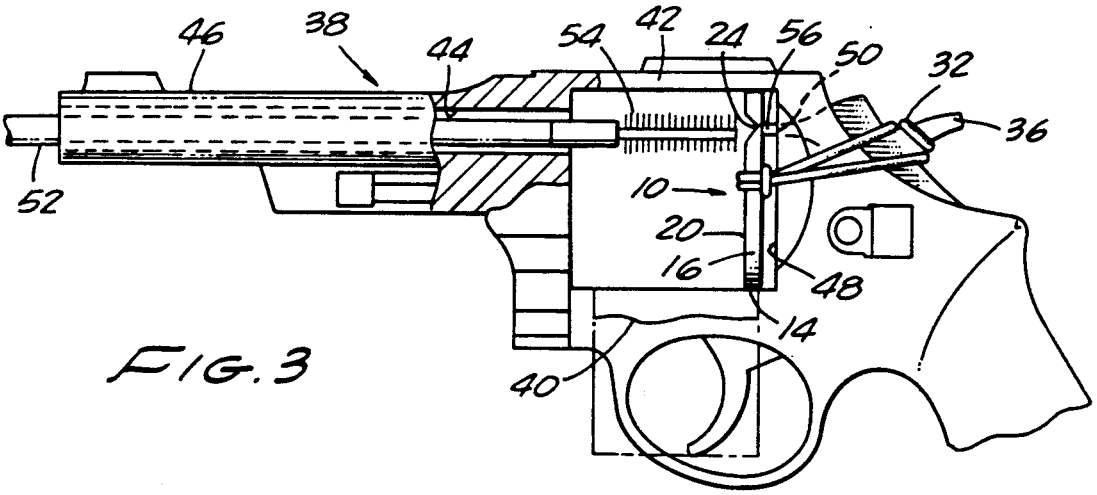
FIG. 3 is a side elevational view of a revolver with an embodiment of the invention fully installed in position to protect the firing pin and the breech face of the revolver.
Figure 4:
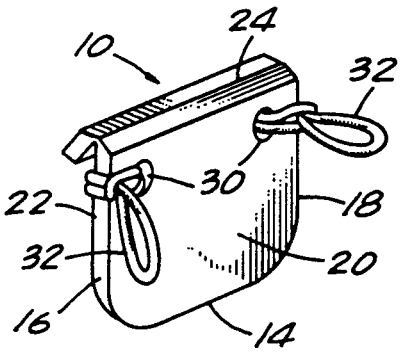
FIG. 4 is a perspective view of an embodiment of the invention showing the folding of the hinge poriton of the invention.
Figure 5:
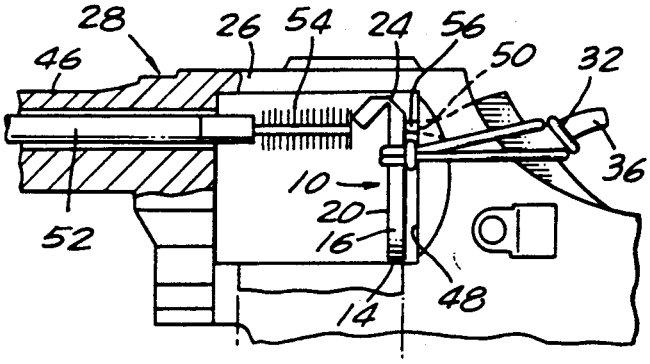
FIG. 5 is a fragmentary side elevational view of a small revolver with the invention folded at its hinge and fully installed in position.

The firing pin protective device or shield 10 is preferably formed from a solid ⅛ inch thick sheet of plastic material impervious to lubricants, cleaning oils and solvents. Suitable materials are preferably polypropylene, polyethylene, or nylon. The ⅛ inch thickness of the plastic sheet may vary plus or minus 10%.

The shield 10 has a top 12 with a flat surface and a bottom 14 with a flat surface and straight parallel sides 16 and 18 preferably formed with rounded corners where they meet the bottom 14 of the shield 10.

A preferred size of the shield 10 is a length from top 12 to bottom 14 of about 1½ inches and a width of about 1 ¼ inches from one parallel side 16 to the other parallel side 18. These dimensions may vary plus or minus 5%.

The front surface 20 and the rear surface 22 of the shield 10 are each planar and parallel to each other, preferably.

The shield 10 is provided with a V-shaped indentation or hinge 24 that has a 90 degree angle in its front surface 20 and which extends from one side 16 to the other side 18 and is parallel with the top 12. The hinge 24 permits folding the top portion of the shield 10 over to allow the shield 10 to be inserted into the frame 26 of a small revolver 28. The hinge 24 is preferably located about ¼ inch below the top 12 of shield 10. The thickness of the shield 10 at the hinge point is preferably 0.025 inch, for easy folding and unfolding, frontwards.

The shield 10 is provided with two apertures or holes 30 preferably about ⅛ inch in diameter and which are preferably located about ⅓ of the distance from the top 12 and about 1/6 of the distance inwards from each of the sides 16 and 18 of shield 10.

Holes 30 receive securing members 32 which are preferably rubber bands that are secured in position at holes 30 by passing one end into the other end to form a securing loop, leaving the other end for attachment to the hammer 36 of a heavy duty revolver 38.

Although other types of securing members may be used to attached the shield 10 to a revolver hammer, such as cords or string, the use of an elastomeric material such as rubber or the like, permits a person to use one hand to keep the shield in position while attaching the securing members to the revolver's hammer with the other hand, which is not possible if the securing members are made of non-elastomeric material.

In operation, the cylinder 40 of a revolver 38 of the heavy duty type is moved away from the revolver's frame 42 to permit the insertion and attachment of the shield 10 before cleaning of the bore 44 of the revolver's barrel 46.

Shield 10, in its open or extended condition, is placed in position covering the revolver's breech face 48 and firing pin hole 50 and is secured to hammer 36 by securing members 32.

A cleaning rod 52 having a brush tip 54 is then inserted into the bore 44 of the revolver's barrel 46 along with cleaning oil or lubricant to clean out bore 44. The shield 10 prevents contact of the brush tip 54 with the breech face 48, which otherwise could cause damage to the firing pin 56 and breech face 48 due to the force exerted upon the cleaning rod 52 in a cleaning operation.

The shield 10 also prevents cleaning oil or solvents used in the cleaning operation as well as any discharge residue or dirt in the bore 44 from entering the working mechanism of the revolver 38.

After the cleaning operation is completed, the shield 10 is easily removed for re-use if desired and the revolver 38 may be reloaded with its firing capability fully effective with the first shot and thereafter.

For a small size revolver, the top portion of shield 10 is folded over at the hinge 24 and then placed in position in the same way as for the heavy duty revolver 38. In its folded condition shield 10 provides the same protection for small revolver 28 as it did for the heavy duty revolver 38.

Although I have described my invention in detail with reference to a preferred embodiment, it is understood that various modifications may be made in the construction and arrangement of parts of the invention without departing from the spirit and scope of the invention as hereinafter claimed.

For example, the shape of the shield 10 may be varied without adversely affecting its operation. Instead of having rounded corners at its bottom, the shield 10 may be completely rectangular in shape or even circular in shape and still be effective to protect the ammunition and working mechanism and firing pin of a revolver. A shield in polygonal shape may be suitable.

However, the location and form of the hinge 24 is critical and must be maintained in the dimensions and relative location described for the preferred embodiment so that the invention may be used for both large and small revolvers.

Further, the front surface 20 below the hinge 24 and the rear surface 22 need not be completely planar or flat for the effective operation of the invention, within reasonable limits, so long as the shield 10 covers the firing pin hole 50 and breech face 48 of a revolver with its rear surface 22 and fits in the frame of the revolver, and so long as the hinge 24 can be folded over frontwards for use in a small revolver.

I claim:

1. A firing pin shield to protect the firing pin and working mechanism of both small and large revolvers during cleaning of the bore of a revolver's barrel with the revolver cylinder moved away from the revolver's frame, comprising:

a shield member made from material impervious to cleaning oils, solvents, and lubricants, and having a polygonal shape with a front surface and a rear surface and a top and a bottom;

an indentation formed in said front surface of said shield member and located in parallel relationship and close proximity to said top of said shield member; and means for securing said shield member to the breech face of a revolver when the cylinder of said revolver is moved away from said revolver's frame.

2. A firing pin shield according to claim 1 in which said shield member is rectangular in form.

3. A firing pin shield according to claim 1 in which said shield member has parallel sides with rounded corners joining said sides to said bottom of said shield member.

4. A firing pin shield according to claim 1 in which said indentation is V-shaped with a 90 degree angle.

5. A firing pin shield according to claim 1 in which the said securing means is elastomeric means.

6. A firing pin shield according to claim 1 in which said shield member is circular in form.

7. A firing pin shield to protect the firing pin and working mechanism of both small and large revolvers during cleaning of the bore of a revolver's barrel with the revolver cylinder moved away from the revolver's frame, comprising:

a shield member made from material impervious to cleaning oils, solvents, and lubricants, and having a generally rectangular shape with a flat top, a flat bottom, parallel sides and a generally planar front surface and a generally planar rear surface;

a V-shaped indentation formed in said front surface of said shield member having a 90 degree angle and located in parallel relationship and close proximity to said top of said shield member and so constructed and arranged as to permit folding frontwards of the portion of said shield member between said top and said indentation; and securing means for securing said shield member to the breech face of a revolver when the cylinder of said revolver is moved away from said revolver's frame.

8. A firing pin shield according to claim 7 in which said securing means is elastomeric.

* * * * *